US005322383A

United States Patent [19]

Saito et al.

[11] Patent Number: 5,322,383

[45] Date of Patent: Jun. 21, 1994

[54] LEVER TYPE CONNECTOR

[75] Inventors: Masashi Saito; Hajime Kawase, both of Yokkaichi, Japan

[73] Assignee: Sumitomo Wiring Systems, Ltd., Yokkaichi, Japan

[21] Appl. No.: 998,679

[22] Filed: Dec. 30, 1992

[30] Foreign Application Priority Data

Mar. 6, 1992 [JP] Japan ..... 4-011340

[51] Int. Cl.[5] ..... H01R 13/00

[52] U.S. Cl. ..... 403/321; 439/157; 439/310; 439/372

[58] Field of Search ..... 439/157, 310, 372; 403/321

[56] References Cited

U.S. PATENT DOCUMENTS

| | | | |
|---|---|---|---|
| 3,124,404 | 3/1964 | Chesnov | 439/310 X |
| 5,135,410 | 8/1992 | Kawase et al. | 439/372 |
| 5,171,156 | 12/1992 | Nagasaka et al. | 439/157 |
| 5,178,553 | 1/1993 | Hatagishi et al. | 439/157 |
| 5,201,665 | 4/1993 | McCardell, Jr. et al. | 439/157 |

FOREIGN PATENT DOCUMENTS

| | | |
|---|---|---|
| 0459448 | 12/1991 | European Pat. Off. . |
| 2179506 | 3/1987 | United Kingdom . |

*Primary Examiner*—Randolph A. Reese
*Assistant Examiner*—Christopher J. Novosad
*Attorney, Agent, or Firm*—Sandler, Greenblum & Bernstein

[57] ABSTRACT

A lever type connector which includes a set of a female connector part and a male connector part to be fitted to each other, and a lever member pivotally journalled on the female connector part. For temporarily stopping the female connector part and the male connector part in place, temporary stopper recesses of the female connector part and temporary stopper projections of the male connector part are engaged with each other. Therefore, it is not necessary to expand the lever member by depression, with guide pins of the male connector part. Thus, combining and releasing of the connector parts are simplified for quick operation.

3 Claims, 4 Drawing Sheets

LEVER TYPE CONNECTOR

BACKGROUND OF THE INVENTION

1. Field of the Invention

The present invention generally relates to a connector, and more particularly, to a lever type connector arranged to couple a set of connector parts to be fitted to each other, through a lever member journalled in either of said connector parts.

2. Description of the Prior Art

Conventionally, for example, in the case where a multi-polar connector having more than twenty poles, etc. is to be connected, since a large coupling force is required, there has been provided a lever type connector arranged to facilitate the connection by applying a comparatively small force through employment of a lever member utilizing the principle of a lever.

For the lever type connector as referred to above, there is available an arrangement, for example, as shown in FIG. 5 in which a lever member 3 is pivotally journalled through support shafts 4 provided on outer walls of one connector part 1 of a set of connector parts 1 and 2, while guide pins 5 are provided to project outwardly from the other connector part 2 for engagement with guide recesses 3*a* formed on said lever member 3, whereby, based on the pivotal operation of said lever member 3, the other connector part 2 is displaced in a direction for fitting or disengagement via the guide recesses 3*a* through guide pins 5.

In the known lever type connector as described above, since the fitting is effected by one hand, it becomes indispensable to temporarily hold or stop the set of connector parts in position, and therefore, it has been a practice to provisionally hold them by inserting the guide pins 5 of the connector part 2 in the starting ends of the guide recesses 3*a* of the lever member 3.

According to the conventional lever type connector of the above described kind, as shown in FIG. 6(A), a shallow insertion groove 3*b* is provided between the starting end and outer end face of each of the guide recesses 3*a* for the lever member 3, and as illustrated in FIG. 6(B), when the guide pins 5 of the other connector part 2 are inserted into said insertion grooves 3*b*, the guide pins 5 are engaged with the starting ends of the guide recesses 3*a* while the lever member 3 being depressed for expansion outwardly, by which a temporary stopping arrangement of a so-called forced insertion type is adopted.

In the lever type connector in general, a large force is applied from the guide recesses 3*a* of the lever member 3 to the guide pins 5 of the other connector part 2 when the set of connector parts 1 and 2 are to be fitted to each other, and therefore, it is necessary to set the length for engagement between the guide pins 5 and the guide recesses 3*a* of the lever member 3 to be long. Since the guide pins 5 tend to be long by the above arrangement, there are problems that such guide pins 5 are difficult to be led into the starting ends of the guide recesses 3*a* of the lever member 3, while on the contrary, they are not easily disengaged from the starting ends of said guide recesses 3*a* when the set of connector parts 1 and 2 are to be disengaged from each other, and thus, much labor is required for the fitting and disengagement of the connector parts, with consequent increase of time required therefor.

Furthermore, in order to provide the temporary stopping mechanism as described above, it is necessary to increase the width of the lever member in a lateral direction by a length L as shown in FIG. 6(B), and thus, the size of the connector is undesirably increased by a width of 2×L at both sides of the connector.

SUMMARY OF THE INVENTION

Accordingly, an essential object of the present invention is to provide a lever type connector which is capable of simply and rapidly effecting fitting and disengagement of its connector parts, and is provided with a temporary stopping structure not increasing the size of the connector on the whole.

Another object of the present invention is to provide a lever type connector of the above described kind, which is simple in structure and stable in functioning at high reliability, and can be readily manufactured at low cost.

In accomplishing these and other objects, according to one preferred embodiment of the present invention, there is provided a lever type connector which includes a set of first and second connector parts to be coupled to each other, a lever member pivotally journalled on said first connector part and having guide recesses formed therein, and guide pins provided to protrude from said second connector part for engagement with said guide recesses of said lever member, so that, by the pivotal operation of said lever member, said second connector part is displaced in a direction to be fitted with or disengaged from said first connector part via said guide recesses of said lever member through said guide pins of said second connector part. The first connector part is provided with temporary stopper recesses, while said second connector part is provided on its side walls with corresponding stopper projections so as to temporarily hold or stop said first and second connector parts in place, at a position where said guide pins of said second connector part are engaged with starting ends of the guide recesses of said lever member.

The temporary recesses with which the stopper projections provided on the second connector part having the guide pins are provisionally engaged, may be formed either on inner faces of side walls of the first connector part on which the lever member is journalled, or on a moving plate disposed on the inner faces of the side walls of said first connector part.

According to the lever type connector of the present invention as described above, owing to the construction that the temporary stopper recesses are provided at positions separate from the guide recesses, with the temporary stopper projections being formed also separate from the guide pins, instead of the conventional structure in which the guide pins are engaged with the starting ends of the guide recesses provided in the lever member, the connector parts can be provisionally held or stopped in position by the engagement of these temporary stopper recesses and projections.

Since concave and convex configurations which may engage each other at the minimum necessary extent are sufficient for the above temporary stopper recesses and projections, such recesses and projections are readily engaged with or disengaged from each other for simple and quick fitting or releasing of the connector parts.

Furthermore, owing to the fact that the guide recesses of the lever member and the guide pins to be inserted into said guide recesses may be designed without providing the temporary stopper mechanism, the freedom of designing may be increased, and the disadvantage in the conventional arrangements that the connector is increased in its size by the increase of lateral width due to provision of the temporary stopper mechanism can also be prevented.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
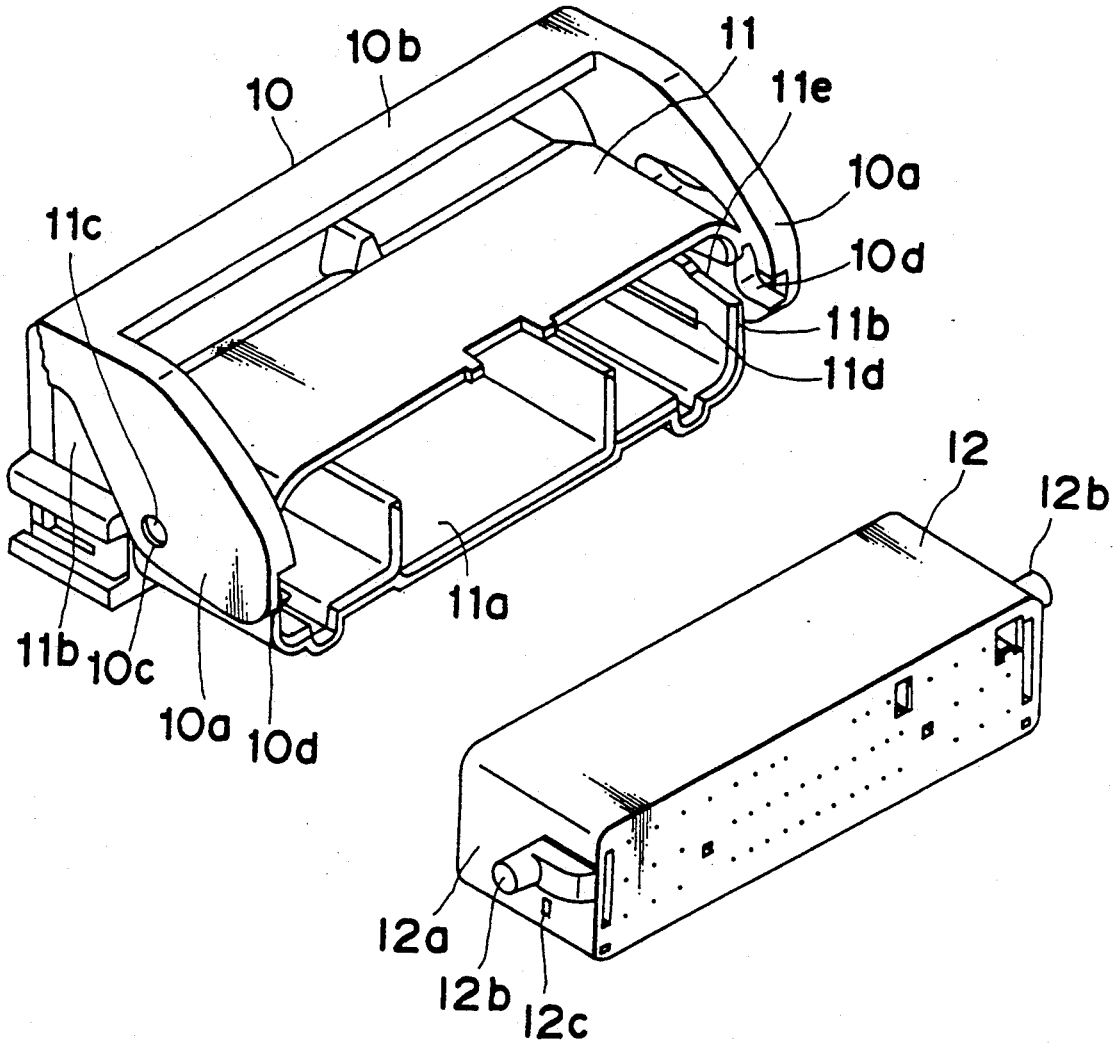
FIG. 1 is an exploded perspective view of a lever type connector according to one preferred embodiment of the present invention.

Before the description of the present invention proceeds, it is to be noted that like parts are designated by like reference numerals throughout the accompanying drawings.

Referring now to the drawings, there is shown in FIG. 1, a lever type connector according to one preferred embodiment of the present invention, which generally includes a female connector part 11 mounted with a lever member 10, and a male connector part 12 as illustrated to be combined with said female connector part 11 in a manner to be described in detail hereinafter.

The female connector part 11 and the male connector part 12 are multi-polar connectors each having many terminal accomodating chambers (not shown) provided side by side, and adapted to be coupled with each other by fitting the male connector 12 into an interior of an opening portion 11*a* of the female connector 11 through an edge portion thereof.

The lever member 10 referred to above is constituted by opposite side portions 10*a* at the left and right sides and a connecting portion 10*b* which connects said opposite side portions 10*a*, and is pivotally supported by the female connector part 11 by fitting shaft holes 10*c* respectively formed in the opposite side portions 10*a*, onto corresponding support shafts 11*c* projecting outwardly from outer faces of opposite side walls 11*b* of the female connector part 11.

Meanwhile, on the outer faces of opposite side walls 12*a* of the male connector 12, guide pins 12*b* respectively protruding outwardly therefrom are provided, and in positions below the respective guide pins 12*b*, temporary stopper projections 12*c* each projecting outwardly to a small extent from said opposite side walls 12*a* are also provided.

In the inner faces of the opposite side portions 10*a* of the lever member 10, arcuate guide recesses or grooves 10*d* are formed for engagement with the guide pins 12*b* of the male connector 12. Each of the guide recesses 10*d* is not required to be shallow at the starting end portion thereof as in the conventional arrangement, but has approximately the same depth over its entire length.

Moreover, in the opposite side walls 11*b* of the female connector 11, elongated openings 11*e* for receiving the guide pins 12*b* of the male connector 12 are formed, while in the inner faces of said opposite side walls 11*b*, temporary stopper recesses 11*d* are formed for engagement with the temporary stopper projections 12*c* of the male connector 12 wherein the temporary stopper recesses 11*d* each include a closed end portion adjacent an inner face of a respective side wall 11*b*.

Figure 2:
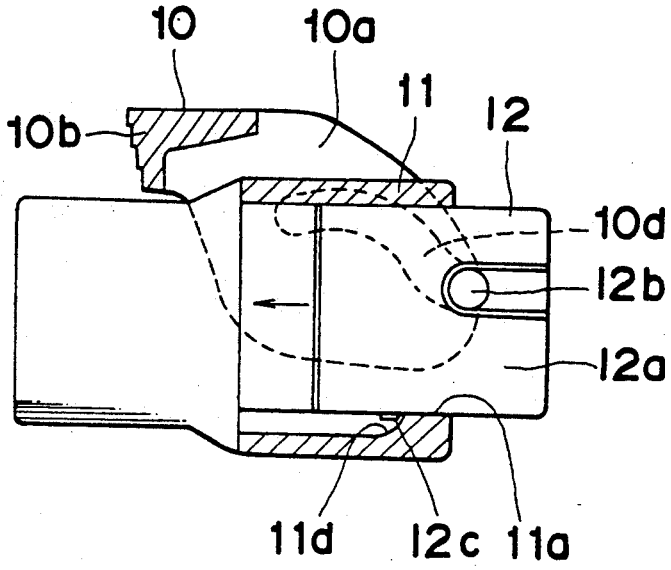
FIG. 2 is a fragmentary cross sectional view of the lever type connector of FIG. 1 at a temporary stopping position.
Figure 3:
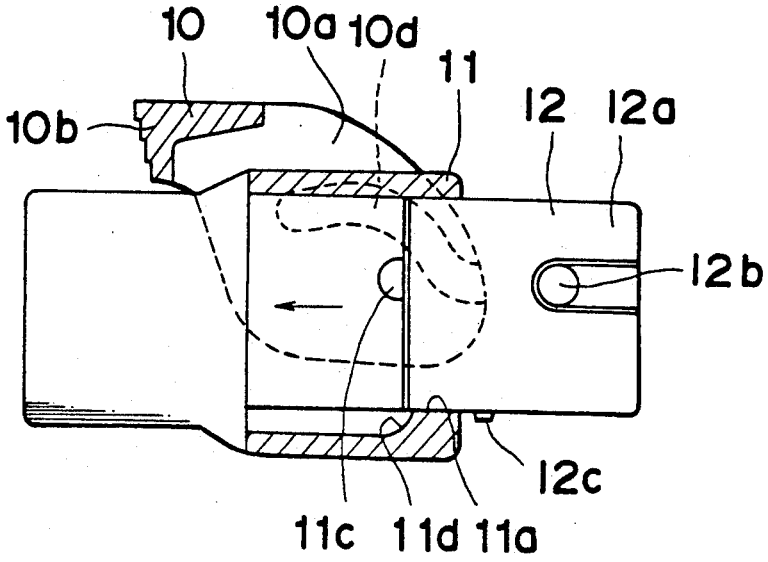
FIG. 3 is a view similar to FIG. 2, which particularly shows the state at an inserting initial position.

It should be noted here that, in the detailed drawings of FIGS. 2 and 3, although the positional relation between the temporary stopper recess 11*d* and the temporary stopper projection 12*c* is differentiated from that shown in FIG. 1 for convenience of drawing it is in short, so arranged that the temporary stopper projections 12*c* of the male connector 12 engage the corresponding temporary stopper recesses 11*d* of the female connector part 11 at the position where the guide pins 12*b* of the male connector part 12 have engaged the starting end portions of the guide recesses 10*d* of the lever member 10.

In the connector of the present invention having the construction as described so far, when the female connector part 11 is to be combined with the male connector part 12, the connector part 12 is inserted into the opening portion 11*a* of the female connector part 11 for fitting therebetween, while depressing said male connector part 12 in a direction indicated by an arrow in FIG. 3 for fitting therebetween.

At an early stage of the above fitting, when the temporary stopper projections 12*c* of the male connector 12 fall into the temporary stopper recesses 11*d* of the female connector part 11 for engagement, after riding over the inner faces of the female connector part 11, said female connector part 11 and male connector part 12 are temporarily held in position through engagement between the temporary stopper recesses 11*d* and the temporary stopper projections 12*c* as shown in FIG. 2. At this time, the guide pins 12*b* of the male connector part 12 are in engagement with the starting end portions of the guide recesses 10*d* of the lever member 10.

Thereafter, when the lever member 10 is turned clockwise in FIG. 2, the guide pins 12*b* of the male connector part 12 are guided by the guide recesses 10*d* of said lever member 10, and thus, the male connector part 12 is displaced in a direction indicated by an arrow in FIG. 2 so as to be fitted deep into the female connector 11 for coupling therebetween.

Meanwhile, for releasing the female connector part 11 from the coupling with the male connector 12, the lever member 10 is turned counterclockwise in FIG. 2, whereby the guide pins 12*b* are guided by the guide recesses 10*d*, and the male connector part 12 is displaced in, the direction opposite to that indicated by the arrow in FIG. 2 so as to be withdrawn up to the temporary stopping position.

Thereafter, when the male connector part 12 is pulled slightly strongly by hand, the temporary stopper projections 12*c* of the male connector part 12 ride over the inner faces of the female connector part 11, and upon further withdrawal thereof as it is, the male connector part 12 is disengaged from the opening portion 11*a* of the female connector part 11.

As described above, since it is sufficient for the temporary stopper projections 12c of the male connector 12 to have the stopping convex shape in such a degree as will engage the temporary stopper recesses 11d of the female connector part 11 at the necessary minimum extent, engagement between the temporary stopper recesses and projections 11d and 12c can be readily established or released, thus making it possible to effect the fitting and disengagement therebetween by a less force in a short period of time.

Figure 4:
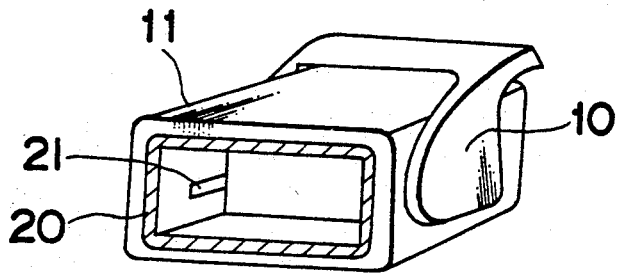
FIG. 4 is a fragmentary perspective view partly in section showing a modification of the lever type connector according to the present invention.
Figure 5:
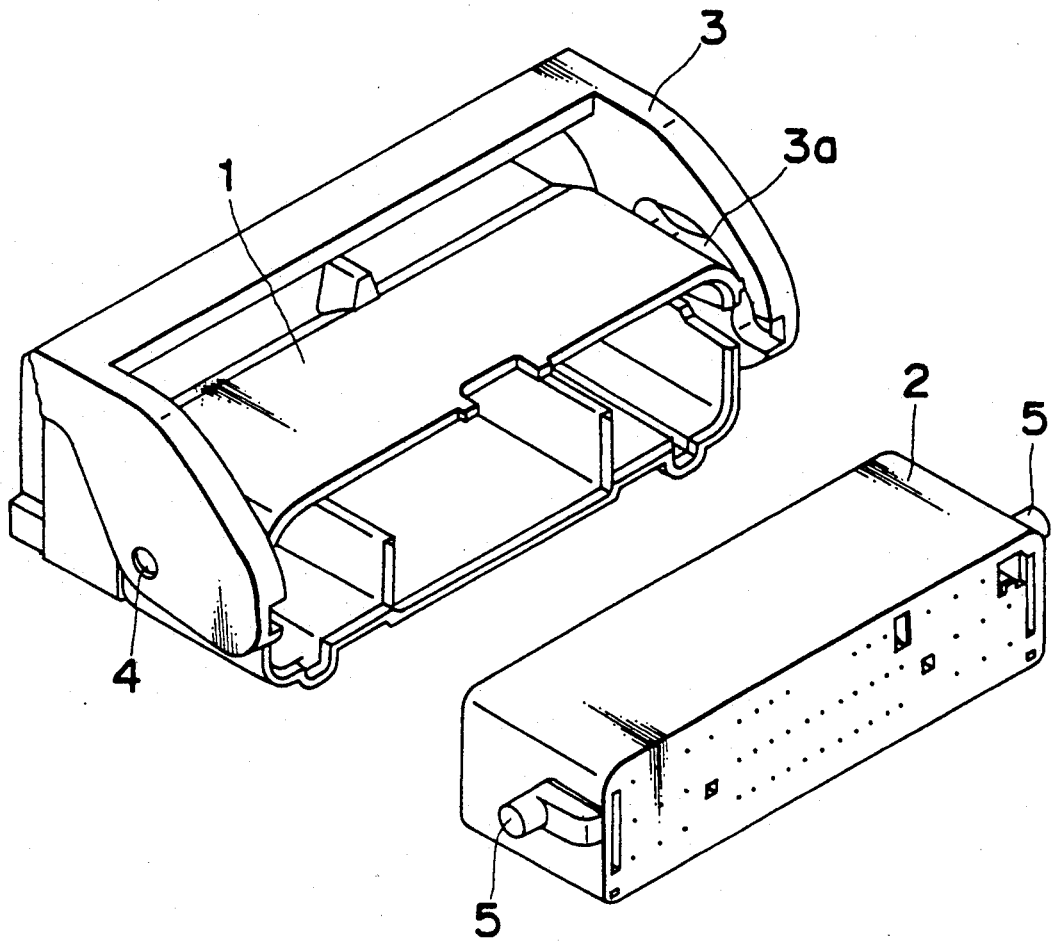
Fig. 5 PRIOR ART
FIG. 5 is a view similar to FIG. 1, which particularly relates to a conventional lever type connector.
Figure 6A:
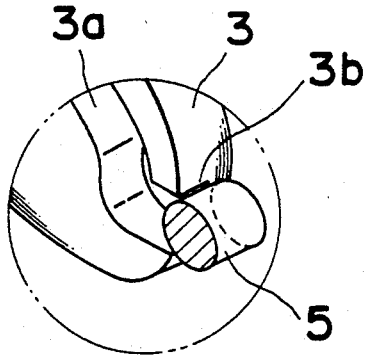
Fig. 6(A) PRIOR ART
FIGS. 6(A) and 6(B) are fragmentary perspective views partly in section, and on an enlarged scale, showing an essential portion of a temporary stopping construction in the conventional lever type connector.
Figure 6B:
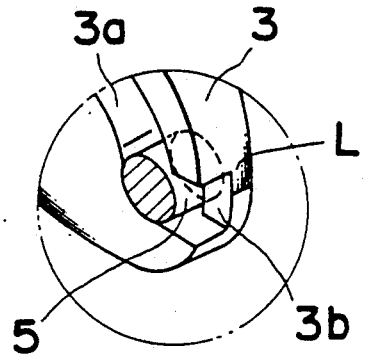
Fig. 6(B) PRIOR ART

It is to be noted here that the concept of the present invention is not limited in its application to the embodiment as described so far, but the arrangement may be, for example, so modified that as shown in FIG. 4, by providing a moving plate 20 which fits into the inner wall of the opening portion 11a of the female connector part 11, temporary stopper recesses 21 are formed in said moving plate 20, so that the temporary stopper projections 12c are provisionally stopped by said temporary stopper recesses 21.

As is clear from the foregoing description, according to the lever type connector of the present invention, since it is so arranged to provisionally stop the connector parts by the temporary stopper recesses and projections formed at separate positions, instead of temporary stopping by engaging the guide pins with the guide recesses formed in the lever member as in the conventional arrangement, it is not necessary to effect forcible entry by expanding the lever member with the guide pins of the connector as in the known connectors. Furthermore, the concave and convex shapes which may allow engagement between the connector parts at the necessary minimum extent are sufficient for the respective temporary stopper portions, such stopper portions are easily engaged or disengaged for simple and quick combining and releasing of the connector parts.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A lever type connector which comprises a set of first and second connector parts to be fitted to each other, a lever member pivotally journalled on said first connector part and having guide recesses formed therein, and guide pins provided to protrude from said second connector part for engagement with said guide recesses of said lever member, so that, by pivotal operation of said lever member, said second connector part is displaced in a direction to be fitted with or disengaged from said first connector part via said guide recesses of said lever member through said guide pins of said second connector part, said first connector part being provided with temporary stopper recesses, and said second connector part being provided on its side walls with corresponding stopper projections, each stopper projection engaging a portion of a corresponding stopper recess so as to temporarily hold said first and second connector parts in a fitted position with respect to each other, at a position where said guide pins of said second connector part are engaged with starting ends of the guide recesses of said lever member wherein said temporary stopper recesses are provided on inner faces of side walls of the first connector part on which the lever member is journaled and wherein said portion of the corresponding temporary stopper recess includes a closed end portion adjacent a portion of an inner face of a respective side wall, whereby when said guide pins of said second connector part are engaging with said starting ends of said guide recess, said stopper projections ride over said portion of the inner faces of the side of the side walls and engage said closed end portion.

2. A lever type connector as claimed in claim 1, wherein said first connector part thereof is of a female connector part, and said second connector part is of a male connector part, both being multi-polar connector parts.

3. A lever type connector as claimed in claim 1, further comprising a moving plate fitted on into an inner wall of an opening portion of said first connector part, and formed with the temporary stopper recesses for provisional engagement with the temporary stopper projections of said second connector part.

* * * * *

UNITED STATES PATENT AND TRADEMARK OFFICE

CERTIFICATE OF CORRECTION

PATENT NO. : 5,322,383

DATED : June 21, 1994

INVENTOR(S) : M. SAITO et al.

It is certified that error appears in the above-indentified patent and that said Letters Patent is hereby corrected as shown below:

At column 6, line 31 (claim 1, line 30), delete "of the side" (first occurrence).

Signed and Sealed this

Tenth Day of December, 1996

*Attest:*

*Attesting Officer*

Bruce Lehman

BRUCE LEHMAN

*Commissioner of Patents and Trademarks*